United States Patent [19]

Shuker et al.

[11] Patent Number: 4,898,364

[45] **Date of Patent: * Feb. 6, 1990**

[54] TWO-SPEED WINCH

[75] Inventors: Brian Shuker, Portsmouth; Richard D. J. Huggett, Horndean, both of United Kingdom

[73] Assignee: Lewmar Marine Limited, Havant, England

[ * ] Notice: The portion of the term of this patent subsequent to Jan. 9, 2007 has been disclaimed.

[21] Appl. No.: 539,407

[22] Filed: Oct. 6, 1983

[30] Foreign Application Priority Data

Oct. 8, 1982 [GB] United Kingdom ..... 8228815
Dec. 30, 1982 [GB] United Kingdom ..... 8237000

[51] Int. Cl.[4] ..... B66D 1/14
[52] U.S. Cl. ..... 254/342; 74/812
[58] Field of Search ..... 254/352, 353, 369, 344, 254/371; 74/812, 810

[56] References Cited

U.S. PATENT DOCUMENTS

Re. 30,881 3/1982 Huggett et al. ..... 74/812 X
708,286 9/1902 Wild ..... 74/812
940,638 11/1909 Hintze ..... 74/812
3,145,974 8/1964 Short ..... 74/812 X
3,712,155 1/1973 Stommel et al. ..... 254/352 X
3,799,005 3/1974 Koehler ..... 254/344 X
3,809,368 5/1974 Lawrence ..... 74/812 X
3,927,580 12/1975 Fawcett ..... 74/812
4,261,549 4/1981 Bonassi ..... 254/344 X

*Primary Examiner*—Katherine A. Matecki
*Attorney, Agent, or Firm*—Cushman, Darby & Cushman

[57] ABSTRACT

A manually powered winch has two geared drive trains. Both originate from a simple set of gear teeth (7) formed into the diameter of a drive input shaft (5). The final drive, common to both gear trains, to an internal gear track (18) on the drum (3) of the winch is one part (12) of a two-part gear (8,12). The part (12) is directly borne by a hub (20) on an axle (10) in the winch. Its gear teeth are on the outer face of an annulus (22) on the inner face of which are ratchets (14) of a pawl-and-ratchet uni-directional drive (14,16) between the two parts (8,12). The other part (8) of the two-part gear is preferably borne not directly on the axle (10) but on the hub (20) of the part (12).

8 Claims, 3 Drawing Sheets

TWO-SPEED WINCH

This invention relates to a winch having only two drive ratios between an input drive shaft and its drum. The drive ratios are achieved by two geared drive trains.

BACKGROUND OF THE INVENTION

In the past the standard way to incorporate a uni-directional drive into such a drive train was to form a ratchet gear in which a central hub was mounted on a shaft and was surrounded by an annulus carrying on its outside the gear teeth which were to mesh with some other gear in the train. Concentricity of the annulus was assured by the sliding bearing surfaces on the outer periphery of the hub and the inner periphery of the ring. There was a pawl and ratchet uni-directional drive linkage between the hub and the ring.

This arrangement was comparatively simple to manufacture and to assemble.

However, in investigating the efficiency of gear trains in the context of winches we have found that that arrangement has a disadvantage which is that, especially because of the very high torque to which such trains are subject when the ratchet gear is the final drive gear before the drum, its efficiency at a time when the pawls are clicking past the ratchet teeth is very low due to high bearing loads on the centering surfaces.

SUMMARY OF THE INVENTION

We have now found and it is the object of this invention to provide a winch with a uni-directional gear which at a time when it is not transmitting drive through its uni-directional drive is of much lower frictional resistance to contra-rotation of two parts of the gear, than the conventional pattern. The gear per se is similar to a gear construction seen, in a different context, in U.K.-B-2061862 (U.S. Re 30881).

The position for the uni-directional gear according to the invention, because it is a situation which involves the maximum load on one part of the gear, is the final gear in a drive of a two-speed winch, with the gear of the one part of the ratchet drive engaging the internal gear track conventionally provided inside the drum for its drive and the second part of the gear being driven in counter-rotation when drive is not being transmitted through the uni-directional drive means between the parts of the gear. Preferably the two-speed winch has only two gears (which are of two parts each and might alternatively be termed two gear stacks of two individual gear faces) between the shaft and the drum, and preferably both are of the defined construction We achieve the desirable effects of the invention by providing the gear teeth on the outer periphery of the gear on a gear part which is fast with a central hub. This hub is either fast with an axle or else rotatably supported on that axle. The second part of the two-part gear is borne concentrically with the first part. The two parts have on them means for uni-directional driving interengagement, usually a ratchet track on one of the parts and pawls on the other. The second part will preferably be borne on the outside of the hub of the first to be rotatable relative to it, though it may be borne on the axle.

In a preferred embodiment the first mentioned part of the two-part gear has its gear teeth on the outer face of a cylindrical annulus, the inner peripheral wall of which is either the ratchet track or is provided with pawls and into which fits at least a portion of the second part of the ratchet gear equipped with its outwardly facing pawls or ratchet track. That is, in this arrangement the second part projects to radially within the track of the teeth of the first part.

The journalling of the first part of the ratchet gear is either on the bearings of the axle or between its hub parts and its axle (in which case rolling contact or sleeve bearings may be provided) and this part may therefore be supported with high concentricity and low friction, the friction moreover occurring much closer to its axis of rotation than was the case in the conventional pattern. The second part may be journalled upon the first part or may be journalled separately upon the same axle as it, and it can be seen that its frictional interaction with the first part is minimised due to the absence of any eccentric loads on it at a time when the gear is not transmitting drive from one of its parts to another.

DESCRIPTION OF THE DRAWINGS AND OF THE PREFERRED EMBODIMENTS

Particular embodiments of the invention will now be described with reference to the accompanying drawings wherein.

Figure 1:
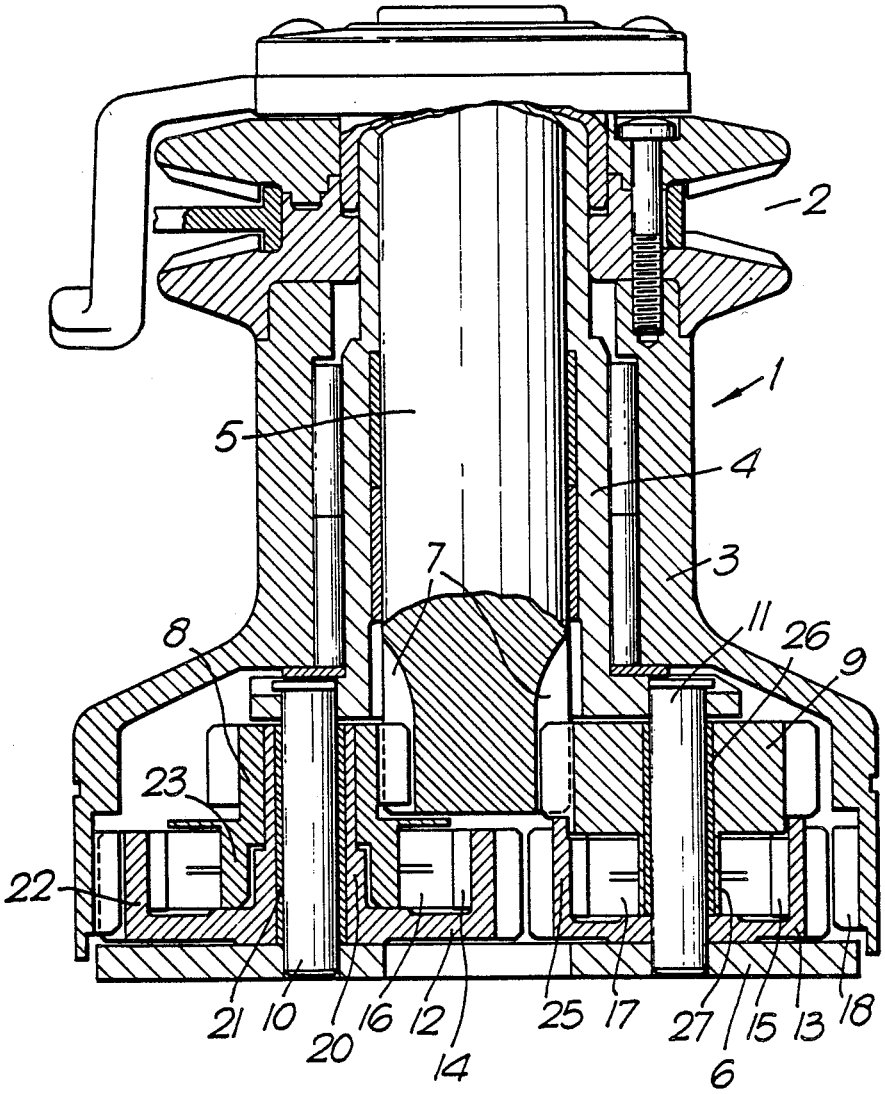
FIG. 1 is a section through a first embodiment.
Figure 3:
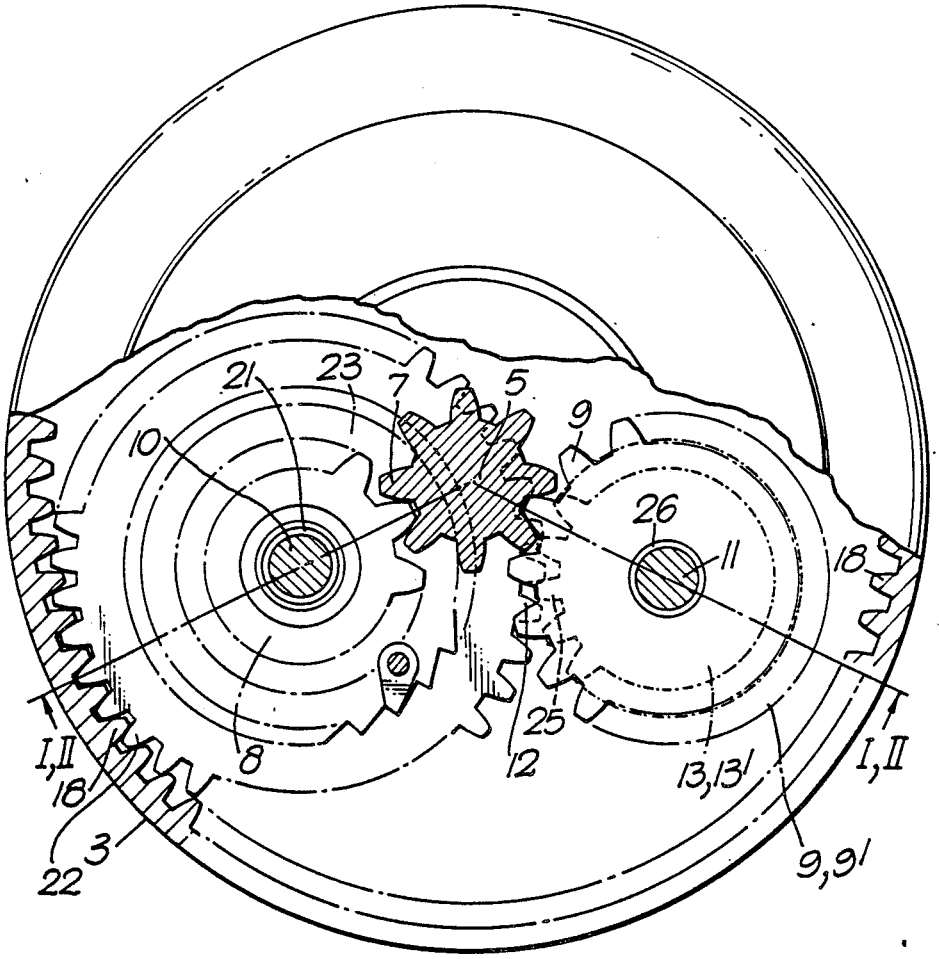
FIG. 3 shows diagrammatically a plan view of either embodiment to illustrate the angular position of the various gears of the train.

The embodiment seen in FIG. 1 is of a self-tailing winch 1 with a self-tailing channel 2 and winch drum 3 borne on a stationary column 4 and driven by a central input drive shaft 5 through a two-speed gear train seen in the lower part of the winch and mounted on its base 6. The self-tailing arrangements and the means by which the drum is supported on the column form no part of the present invention which is concerned solely with the gear trains and with at least one of the gears which is found in those trains. The winch is of a type wherein the drum is driven in one direction at successively different speed ratios automatically by reversal of the input drive shaft 5. Drive is communicated from that shaft via gear teeth 7 (formed by axial grooves formed into the diameter of the shaft 5 at its lower end) and each permanently meshing with a gear of both of the drive trains, which include respectively a first ratchet gear 8,12 and a second ratchet gear 9,13. The first ratchet gear is mounted on axle 10 and the second ratchet gear on shaft 11. The first ratchet gear has a first part 12 and the second ratchet gear also has a first part 13, gear teeth on the outside of the parts 12,13 being in permanent meshing engagement with each other, the angular arrangement of axles 10,11 being seen more clearly in FIG. 3. The second part 8 of the first gear and second part 9 of the second gear both mesh with the teeth 7 on the shaft. The parts 9,13 and 8,12 respectively have unidirectional coupling between them which are formed by a ratchet track 14,15 on the parts 12,13 and pawls 16,17 on the parts 8 and 9. These are set to drive in respectively opposite senses of rotational and the arrangement is such that when the input drive shaft 5 is first turned in an anti-clockwise direction as seen in FIG. 3. (a keyed handle being fitted in the socket in the head of the shaft for this purpose) drive is transmitted from the teeth 7 on the shaft to gear part 8 which through its pawl 16 and ratchet track 14 drives the gear part 12 which is permanently meshed with an internal gear track 18 on the inside of the base of the drum 3. The shaft also rotates the gear part 9 clockwise but the pawls and ratchets 15,17 being oppositely set no drive is transmitted to the gear part 13 which is therefore free to rotate, being driven by the part 12. Wherever the shaft 5 is rotated clockwise, the drive is taken up through the pawl 17 and the ratchet track 15 to the gear part 13, which, meshing with the gear part 12 of the other ratchet gear causes drive to be transmitted through that to the gear track 18 in the drum. At this stage ratchets and pawls 14,16 are not transmitting drive and are clicking past each other, and gear parts 8,12 are counter-rotating.

The construction of both the ratchet gears is designed to minimise eccentricity and friction particularly when not transmitting drive through their own pawl and ratchet drives.

The first gear is made up of parts 8 and 12. The part 12 which provides the track of teeth has a hub with a central sleeve 20 borne through either a solid or a rolling bearing 21 on the surface of the axle 10. A flange then extends to the skirt 22 forming the outer periphery of this ratchet gear part and on the outer face of which are formed the gear teeth. On its peripheral inner face are formed the ratchets of the ratchet track 14. The other part 8 of this gear has also a sleeve within its gear track and this is mounted directly on the outer periphery of the sleeve 20 and is rotatable about it. A somewhat larger diameter sleeve projects downwardly at 23 into the recess formed between the sleeve 20 and the outer peripheral skirt 22 of the first gear part. Spring loaded pawls 16 are mounted on this downwardly projected part 23 for engagement with the ratchet track 14 upon appropriate drive of the two parts.

It can be seen that eccentric loads on the gear part 12 are taken directly onto the shaft 10, something which is particularly important when the gear part 12 is being used to transmit drive from gear part 13 to the drum and when the pawls and ratchets 14,16 are clicking past each other. The rotational bearing surface is at a low radius from the centre of rotation and there is little or no bearing load, in this condition, on the part 8, all of which adds considerably to the efficiently and lack of drag of the winch in that state.

The gear made up of gear parts 9,13 has gear part 13 being borne directly on its shaft 11 and providing an outer peripheral skirt 25 upon the outer periphery of which the gears are formed and on the inner periphery of which is seen the ratchet track 15. The gear part 9 is journalled on the shaft 11 through a sleeve or rolling contact bearing 26 and offers a downwardly projecting sleeve part 27 within which are pivotally housed the pawls 17. Again it can be seen that the two parts of the ratchet gear are rendered independent of each other in the sense of one not having to bear any eccentric load exerted on the other.

Figure 2:
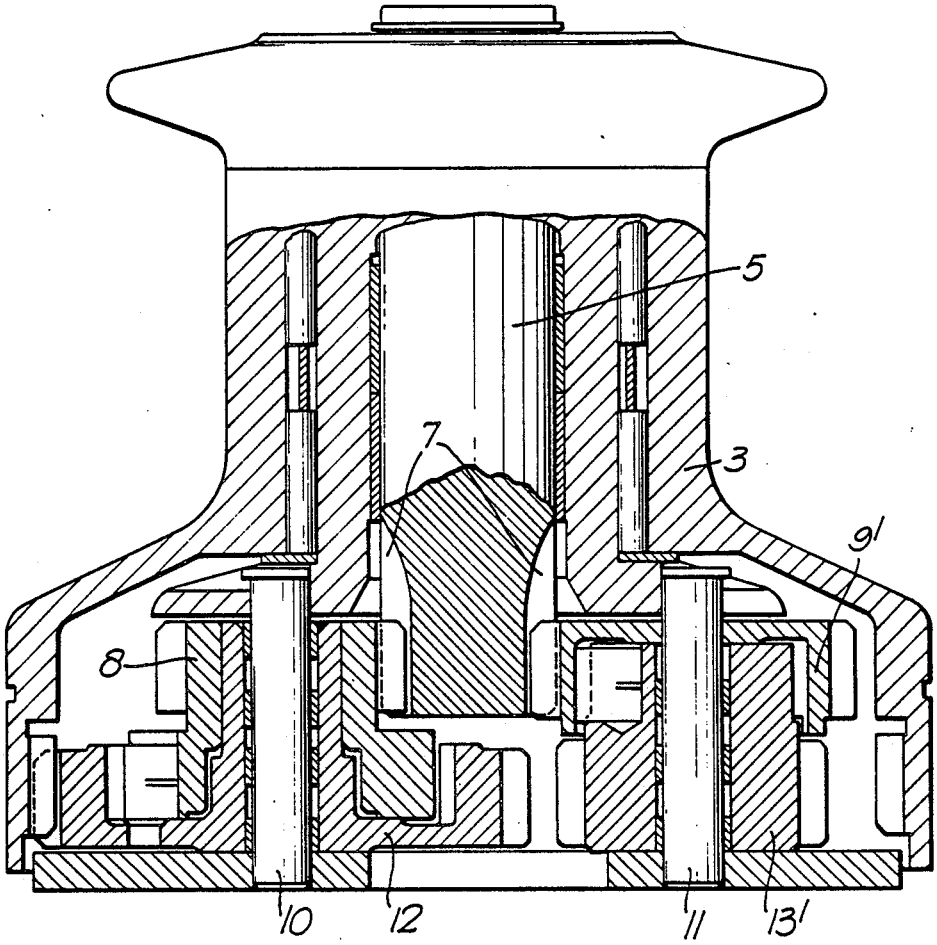
FIG. 2 is a section through a second embodiment.

FIG. 2 illustrates the invention in a simple non-self-tailing winch and as before interest lies entirely in the gear train and at least one of the gears making it up. In this case the central shaft referred to as 5 once more has gear teeth 7 which engages on the one hand with a gear part 8 of a first ratchet gear 8,12 indistinguishable in construction and function, to that described with respect to FIG. 1.

The other gear with which the teeth 7 mesh and which is mounted on an axle 11 as before shows however how the positioning and journalling of the two gear parts may be in effect inverted. The gear part here referred to as 9' although functionally identical to the gear part 9 of the first embodiment has a conformation virtually identical to that of gear part 13 of the first embodiment, while the gear part here referred to as 13' has a conformation in function virtually identical with that of gear part 9 of the first embodiment. The functioning of the second embodiment is exactly the same as that of the first in all particulars.

The constructions of gear described above may be applied in principle when there are different uni-directional links between the parts of the gear - e.g. camming roller or rocker catch arrangements could be used.

What we claim is:

1. A manually powered winch having an input drive shaft and a winch drum, there being only two geared drive trains between the input drive shaft and the drum, an annular gear track on an inner wall of the drum, a unidirectional gear borne on an axle in the winch, the unidirectional gear comprising two parts, a first of said two parts comprising gear teeth engaging with the gear track and a hub joined to the gear teeth, the said first part being the final drive to the gear track from both said geared drive trains, the gear teeth of the first part being permanently engaged by teeth of a gear of one of the drive trains, and means being provided whereby the first part is also engageable by a second part of the said two parts of the unidirectional gear, the said second part being borne by a portion of the hub of the first part for rotation about that portion and the axle, and unidirectional drive means between the said first and second parts, the said second part having gear teeth being a member of the other of the said drive trains.

2. A manually powered winch according to claim 1, wherein the said gear of the one of the drive trains is connected through unidirectional drive means to an other gear of the one drive train, the said second part of the two parts having gear teeth, the gear teeth of the second part and those of the other gear of the one drive train both being directly and permanently engaged with gear teeth on the drive shaft.

3. A manually powered winch according to claim 2, wherein the gear teeth of the second part and those of the other gear of the one drive train both engage the same gear teeth on the drive shaft.

4. A manually powered winch according to claim 3, wherein the said gear teeth on the drive shaft have a maximum diameter the same as that of the drive shaft and are defined by channels in the material of the drive shaft.

5. A manually powered winch according to claim 1, wherein both said drive trains include gear teeth on the drive shaft, and the said gear teeth on the drive shaft have a maximum diameter the same as that of the drive shaft and are defined by channels in the material of the drive shaft.

6. A manually powered winch according to claim 1 wherein the gear teeth of the first part are arranged on an outer periphery of a cylindrical annulus, the uni-directional drive means comprising uni-directional drive elements on an inner periphery of the cylindrical annulus, said second gear part comprising unidirectional drive elements on an outer peripheral portion thereof whereby the uni-directional drive means lies within the cylindrical annulus and axially spaced from the gear teeth of the second gear part, the said gear teeth of the second gear part lying axially outside at least a portion of the said hub portion.

7. A manually powered winch having two geared drive trains wherein a final drive to a gear track on a drum of the winch is provided in common to both geared drive trains by one part of a two-part gear, the one part including an annulus, gear teeth on the outer circumference of the annulus to mesh with those of the gear track, one side of a uni-directional drive means on the inner circumference of the annulus, a hub of the one part supported on an axle in the winch, the second part of the two-part gear also being supported on the hub for being rotatable about the hub and including a second side of uni-directional drive means engageable with the said one side to effect uni-directional driving engagement between the two parts.

8. A manually powered winch according to claim 7, wherein both geared drive trains originate from a single set of gear teeth on a drive input shaft of the winch, the said set being axially directed tooth-grooves formed into the material of the drive shaft at one end thereof.

* * * * *